US008720566B2

(12) United States Patent
Banack

(10) Patent No.: US 8,720,566 B2
(45) Date of Patent: May 13, 2014

(54) SLOT PERFORATING TOOL

(75) Inventor: Benjamin M. Banack, Grande Prarie (CA)

(73) Assignee: Halliburton Energy Services, Inc., Houston, TX (US)

( * ) Notice: Subject to any disclaimer, the term of this patent is extended or adjusted under 35 U.S.C. 154(b) by 485 days.

(21) Appl. No.: 12/776,755

(22) Filed: May 10, 2010

(65) Prior Publication Data

US 2011/0272157 A1 Nov. 10, 2011

(51) Int. Cl.
*E21B 43/114* (2006.01)

(52) U.S. Cl.
USPC ..... 166/298; 166/297; 166/55.2

(58) Field of Classification Search
CPC ..... E21B 43/114; E21B 43/119; E21B 29/00; E21B 29/06
USPC ..... 166/298, 297, 55.1, 55.2, 55.3
See application file for complete search history.

(56) References Cited

U.S. PATENT DOCUMENTS 3,329,209 A * 7/1967 Kisling, III ..... 166/128
3,986,554 A * 10/1976 Nutter ..... 166/319
4,134,453 A * 1/1979 Love et al. ..... 166/298
4,346,761 A * 8/1982 Skinner et al. ..... 166/206
4,403,659 A * 9/1983 Upchurch ..... 166/374
4,889,187 A * 12/1989 Terrell et al. ..... 166/298
4,905,775 A * 3/1990 Warren et al. ..... 175/38
4,928,757 A * 5/1990 Schellstede et al. ..... 166/55.1
5,107,943 A * 4/1992 McQueen et al. ..... 175/267
5,249,628 A 10/1993 Surjaatmadia
5,325,923 A 7/1994 Surjaatmadja et al.
5,327,970 A * 7/1994 McQueen et al. ..... 166/278
5,335,724 A 8/1994 Venditto et al.
5,361,856 A 11/1994 Surjaatmadja et al.
5,366,015 A 11/1994 Surjaatmadja et al.
5,396,957 A 3/1995 Surjaatmadja et al.
5,423,382 A * 6/1995 Barton et al. ..... 166/297
5,484,016 A 1/1996 Surjaatmadja et al.
5,494,103 A * 2/1996 Surjaatmadja et al. ..... 166/222
5,499,678 A 3/1996 Surjaatmadja et al.
5,787,983 A 8/1998 Heathman et al.
6,012,525 A * 1/2000 Burleson et al. ..... 166/297
6,209,645 B1 * 4/2001 Ohmer ..... 166/298
6,286,599 B1 * 9/2001 Surjaatmadja et al. ..... 166/298
7,017,665 B2 3/2006 Nguyen
7,059,406 B2 6/2006 Nguyen
7,195,067 B2 * 3/2007 Manke et al. ..... 166/298
7,225,869 B2 * 6/2007 Willett et al. ..... 166/280.1
7,431,094 B2 * 10/2008 De Clute-Melancon ..... 166/377
7,571,766 B2 * 8/2009 Pauls et al. ..... 166/280.1

(Continued)

*Primary Examiner* — Shane Bomar
*Assistant Examiner* — Wei Wang
(74) *Attorney, Agent, or Firm* — McDermott Will & Emery LLP; John W. Wustenberg

(57) ABSTRACT

An apparatus including a body, a mandrel disposed at least partially within the body, and a spring. The spring maintains the mandrel in a retracted position within the body until a predetermined pump rate is applied. The spring allows the mandrel to move to an extended position when the predetermined pump rate is applied. The spring returns the mandrel to the retracted position within the body when the predetermined pump rate is removed.

14 Claims, 2 Drawing Sheets

(56) References Cited

U.S. PATENT DOCUMENTS

| | | | | |
|---|---|---|---|---|
| 7,584,791 | B2 | 9/2009 | Robb et al. | |
| 7,690,431 | B2 * | 4/2010 | Nguyen et al. | 166/311 |
| 7,766,086 | B2 * | 8/2010 | Mondelli et al. | 166/374 |
| 2005/0183741 | A1 | 8/2005 | Surjaatmadja et al. | |
| 2006/0027368 | A1 * | 2/2006 | Manke et al. | 166/298 |
| 2007/0007009 | A1 | 1/2007 | Nguyen | |
| 2008/0060810 | A9 | 3/2008 | Nguyen et al. | |
| 2008/0110622 | A1 * | 5/2008 | Willett et al. | 166/280.2 |
| 2008/0283299 | A1 * | 11/2008 | Surjaatmadja | 175/67 |
| 2009/0223714 | A1 * | 9/2009 | Hill et al. | 175/2 |

* cited by examiner

SLOT PERFORATING TOOL

BACKGROUND

The present invention relates to tools useful in treating subterranean formations, and more particularly, to slot perforating tools.

There are a number of methods used in perforating wells. One method includes utilizing a jetting tool through which a jetting fluid passes at a pressure high enough to cut openings, or perforate the well casing. The jetting tool, typically including a plurality of jetting nozzles, is lowered into the well on the tubing string through which jetting fluid is displaced.

It is often desirable to cut slots in the wells as opposed to simply creating holes, or generally circular areas. Slots create a greater area through which treating fluid can be passed and also a greater area for the return of production fluid from the formation. One technique that has been attempted involves lifting or pulling the entire tubing string while jetting to create slots in the casing. However, it can be difficult to pull tubing string consistently out of a wellbore while perforating. In particular, jointed pipe is not susceptible to pulling while pumping and coiled tubing is prone to stretch and/or contract, resulting in inconsistent movement of the bottomhole assembly. Further, such pulling can result in high pipe fatigue.

SUMMARY

The present invention relates to tools useful in treating subterranean formations, and more particularly, to slot perforating tools.

An apparatus may comprise a body, a mandrel disposed at least partially within the body, and a spring. The spring may be configured to maintain the mandrel in a retracted position within the body until a predetermined pump rate is applied to the apparatus. The spring may be configured to allow the mandrel to move to an extended position when the predetermined pump rate is applied to the apparatus. The spring may be configured to return the mandrel to the retracted position within the body when the predetermined pump rate is removed from the apparatus.

A method may comprise providing the apparatus, providing a perforating tool connected to the apparatus, placing the apparatus and the connected perforating tool in a wellbore, initiating a perforation through the perforating tool, and applying the predetermined pump rate, causing the mandrel to move from the retracted position within the body to the extended position, thereby moving the perforating tool while extending the perforation.

The features and advantages of the present invention will be readily apparent to those skilled in the art. While numerous changes may be made by those skilled in the art, such changes are within the spirit of the invention.

BRIEF DESCRIPTION OF DRAWINGS

This drawing illustrates certain aspects of some of the embodiments of the present invention, and should not be used to limit or define the invention.

Figure 1:
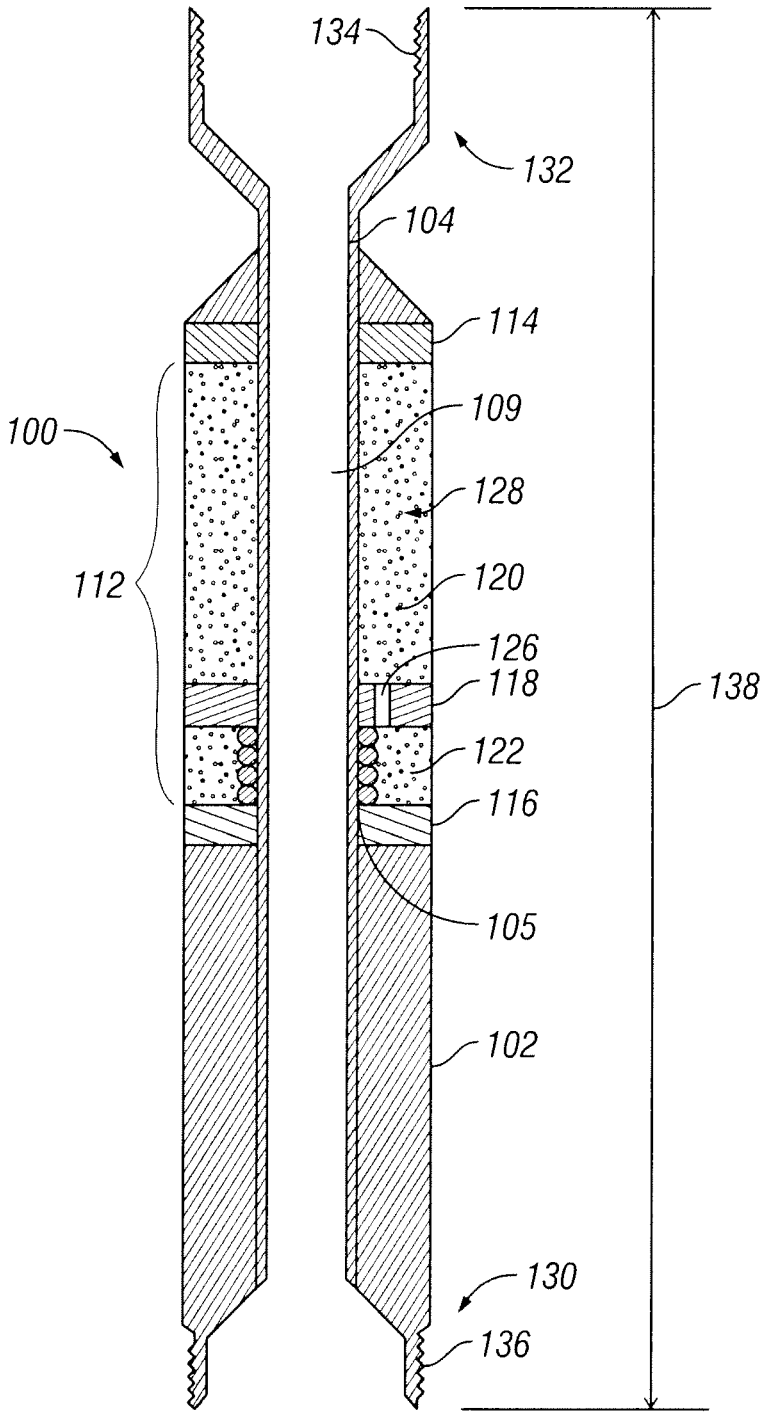
FIG. 1 is a cutaway side view of a slot perforating tool in a retracted position in accordance with one embodiment of the present invention.

While the present invention is susceptible to various modifications and alternative forms, a specific exemplary embodiment thereof has been shown by way of example in the drawings and is herein described in detail. It should be understood, however, that the description herein of specific embodiments is not intended to limit the invention to the particular form disclosed, but on the contrary, the intention is to cover all modifications, equivalents and alternatives falling within the spirit and scope of the invention as defined by the appended claims.

DETAILED DESCRIPTION

The present invention relates to tools useful in treating subterranean formations, and more particularly, to slot perforating tools. In some embodiments, a slot perforating tool may provide for movement of a bottomhole assembly within the wellbore without moving the tubing string, which may allow for more efficient perforation of slots.

Figure 2:
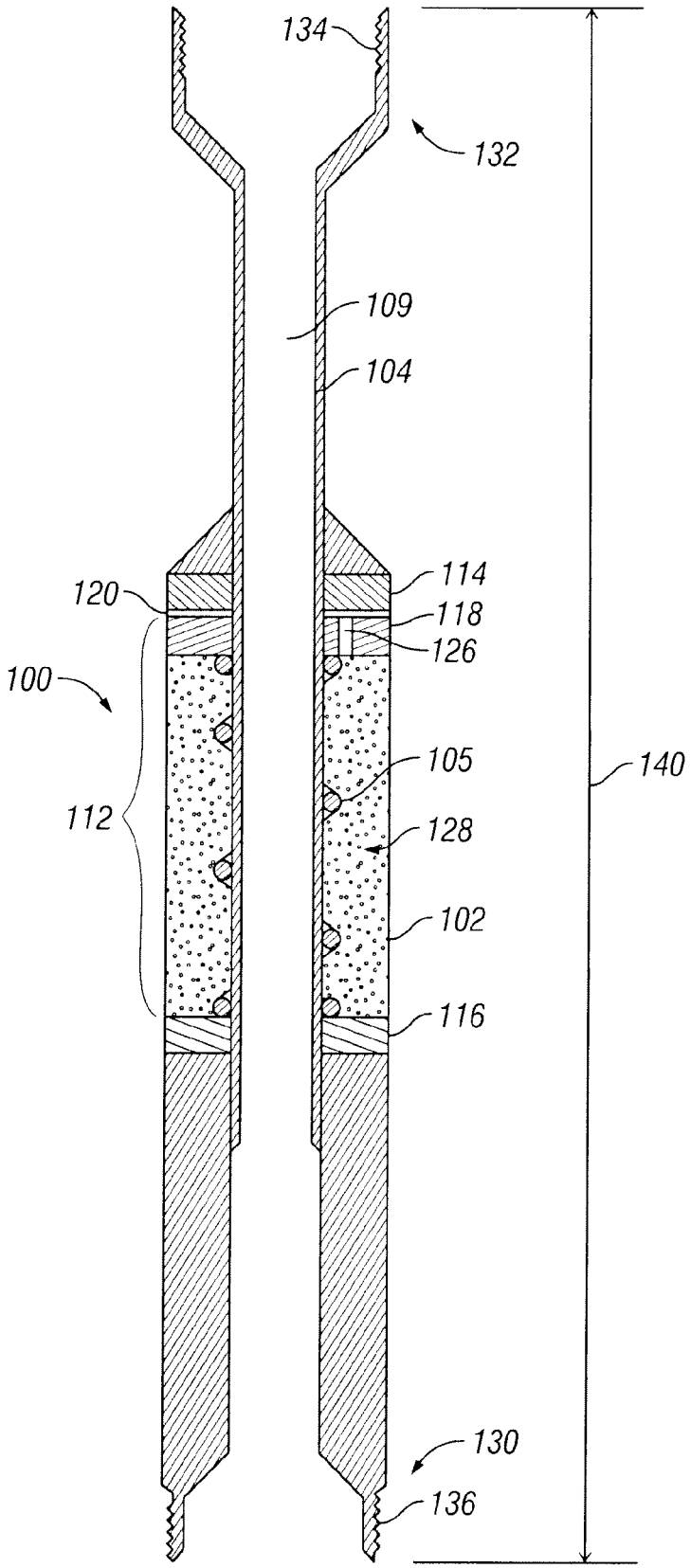
FIG. 2 is a cutaway side view of the slot perforating tool of FIG. 1, in an extended position in accordance with one embodiment of the present invention.

Referring to FIG. 1, slot perforating tool 100 may have body 102, mandrel 104, and spring 105. Mandrel 104 may be generally disposed within and moveable with respect to body 102, such that slot perforating tool 100 has at least one retracted position, and at least one extended position (e.g., as shown in FIG. 2). Referring still to FIG. 1, in a retracted position, mandrel 104 may be generally surrounded by body 102, such that little or no mandrel 104 extends beyond body 102. In other positions (e.g., the extended position illustrated in FIG. 2), mandrel 104 may only be partially situated within body 102, such that a greater portion of mandrel 104 extends beyond body 102. In some embodiments, only a small portion of mandrel 104 may extend beyond body 102.

Body 102 may be substantially tubular, allowing mandrel 104 to at least partially fit therein. In some embodiments, body 102 is constructed of metal or other material suitable for use in wellbores. The construction and dimensions of body 102 may vary, depending on the particular conditions present.

Mandrel 104 may also be substantially tubular, or otherwise have passage 109 extending from one end of mandrel 104 to the other end of mandrel 104, so as to allow wellbore fluids to pass through mandrel 104, when mandrel 104 is disposed within body 102. Passage 109 may have a constant cross section throughout mandrel 104, or the cross section of passage 109 may vary, depending on the particulars of the job. Mandrel 104 may move axially within body 102, allowing the length of slot perforating tool 100 to vary. When slot perforating tool 100 is placed between a tubing string and a bottomhole assembly including one or more tools (e.g., a perforating tool), the variable length of slot perforating tool 100 may allow for the bottomhole assembly to move axially with respect to the tubing string without the need to axially move the entire tubing string. Likewise, in some embodiments, mandrel 104 may move rotationally within body 102, allowing rotational movement of the bottomhole assembly without rotational movement of the entire tubing string.

Chamber 112 may be formed between body 102 and mandrel 104. More particularly, chamber 112 may be defined by body 102, mandrel 104, upper seal 114 and lower seal 116. Upper seal 114 and lower seal 116 may be rings, spacers, or other devices which allow mandrel 104 to move relative to body 102, while preventing substantial fluid from passing into or out of chamber 112 (e.g., isolating chamber 112 from treatment fluids and/or wellbore fluids). In some embodiments, upper seal 114 and lower seal 116 may be fixed to body 102. In other embodiments, upper seal 114 and lower seal 116 may be fixed to mandrel 104.

Middle seal 118 may lie between upper seal 114 and lower seal 116 within chamber 112, and may be similar in construction to upper seal 114 and lower seal 116. Middle seal 118 may thus be formed between body 102 and mandrel 104. Chamber 112 may generally be divided into upper cell 120 and lower cell 122 by middle seal 118. In embodiments where upper seal 114 and lower seal 116 are fixed to body 102, middle seal 118 may be fixed to mandrel 104, such that a volume within chamber 112 remains substantially constant, while volumes in upper cell 120 and lower cell 122 vary. Likewise, when upper seal 114 and lower seal are fixed to mandrel 104, middle seal 118 may be fixed to body 102 for the same effect. In any event, upper cell 120 may be defined by body 102, upper seal 114, mandrel 104, and middle seal 118, while lower cell 122 may be defined by body 102, middle seal 118, mandrel 104, and lower seal 116. When upper seal 114 and lower seal 116 effectively seal chamber 112, and middle seal 118 prevents passage of fluid between upper cell 120 and lower cell 122, fluid passage 126 may allow fluid within chamber 112 to move from upper cell 120 to lower cell 122 and vice versa. As illustrated, fluid passage 126 is a capillary or small opening formed in middle seal 118. Alternatively, fluid passage 126 may have multiple ports with valves. Hydraulic fluid 128 may be present in either or both of upper cell 120 and lower cell 122. Thus, when mandrel 104 moves relative to body 102 in a first direction, hydraulic fluid 128 may pass from upper cell 120 through fluid passage 126 and into lower cell 122. Likewise, when mandrel 104 moves relative to body 102 in an opposite direction, hydraulic fluid 128 may pass from lower cell 122 through fluid passage 126 and into upper cell 120. Fluid passage 126 may be sized and/or otherwise designed to control the speed at which mandrel 104 may move relative to body 102. Smaller passages would prevent free flow from upper cell 120 to lower cell 122 and vice versa, which would slow movement of mandrel 104, while larger passages would allow for faster movement of mandrel 104. Valves in fluid passage 126 may include one or more one-way valves, so as to allow for movement from the extended position to the retracted position more rapidly than the transition from the retracted position to the extended position, or vice versa. Thus, one or more slot perforations may be created at optimal or designed tubing rates, based on the calibrated size and/or design of fluid passage 126.

Spring 105 may be an energy storing or absorbing device configured to substantially hold, keep, or maintain mandrel 104 in a retracted position within body 102, when slot perforating tool 100 is in a neutral position. In other words, spring 105 may have a bias that causes mandrel 104 to be substantially protected by body 102 during run-in or other wellbore operations. Spring 105 may be designed to allow mandrel 104 to move away from the retracted position upon application of a predetermined pump rate to slot perforating tool 100. At the predetermined pump rate, a pressure drop may form across slot perforating tool 100, causing tension, which may exceed the force of the spring holding mandrel 104 in body 102. Thus, spring 105 may be loaded to the point that the holding strength of spring 105 may be overcome at a predetermined set point, at which mandrel 104 will begin moving at a speed determined by the makeup of the fluid within chamber 112, and/or the design of fluid passage 126. Thus, mandrel 104 may move to an extended position, where a larger portion of mandrel 104 is outside of body 102. When the pump rate is reduced, removed or otherwise no longer present at the predetermined pump rate, the force of spring 105 may be larger than the tensile force on slot perforating tool 100, and spring 105 may cause fluid to move through fluid passage 126, as mandrel 104 returns to the retracted position within body 102.

In some embodiments, spring 105 may be a tension spring, tending to "pull" mandrel 104 into body 102. This is illustrated in FIG. 1, where spring 105 lies within lower cell 122. In such embodiments, spring 105 may be fixedly attached, or otherwise connected to body 102 at one end and to mandrel 104 at the other end. In other embodiments (not illustrated), spring 105 may be a compression spring lying in upper cell 120, and may not need to be connected to mandrel 104 and/or body 102, but instead may be in contact without being affixed. Spring 105 may be formed of any of a number of materials, including, but not limited to metals.

Slot perforating tool 100 may have tool connector 130 and/or tubing string connector 132. Tool connector 130 may be any type of connection or junction for joining, attaching, or otherwise engaging a bottomhole assembly, which may include a downhole tool to slot perforating tool 100. For example, but not by way of limitation, tool connector 130 may be male threaded connection 136 suitable for threadedly connecting a bottomhole assembly or other tool (e.g., a jetting or perforating tool) to slot perforating tool 100. Likewise, tubing string connector 132 may be any type of connection or junction for joining, attaching, or otherwise engaging a tubing string to slot perforating tool 100. For example, but not by way of limitation, tubing string connector 132 may be female threaded connection 134 suitable for threadedly connecting a tool string to slot perforating tool 100.

Referring now to FIG. 1 and FIG. 2 together, in a particular embodiment, a retracted position (FIG. 1) has mandrel 104 substantially contained or disposed within body 102. Spring 105 is a tension spring within lower cell 122 of chamber 112 and connected to mandrel 104 at one end and to body 102 at the other end. Lower cell 122 of chamber 112 is of a relatively small volume, as compared to upper cell 120 of chamber 112, and slot perforating tool 100 has a retracted length 138. After the predetermined pump rate is applied, but before it is removed, an extended position (FIG. 2) has mandrel 104 extending beyond body 102. The tensile force inherent in tension spring 105 has been overcome, and mandrel 104 has moved outwardly from body 102, pulling with it middle seal 118. As middle seal 118 moved upward, hydraulic fluid 128 passed from upper cell 120 of chamber 112, through fluid passage 126 and into lower cell 122 of chamber, at a controlled rate, predetermined by the size of fluid passage 126 and/or formulation of hydraulic fluid 128. When in a fully extended position, extended length 140 of slot perforating tool 100 may be larger than retracted length 138 of slot perforating tool 100 in a retracted position. For example, retracted length 138 may be between about 50% and about 90% of extended length 140. In some embodiments, retracted length 138 may be between about 60% and about 80% of extended length 140, and in some embodiments, retracted length 138 may be about 70% of extended length 140. The extent of the change of length may be selected based on the particular conditions. For example, a more stable slot perforating tool 100 may be desired in certain applications, which may result in a reduced difference between extended length 140 and retracted length 138. In such cases, or in other applications, it may be desirable to install two or more slot perforating tools 100 on a tubing string to allow for appropriate changes in length. Depending on the circumstances, the various slot perforating tools 100 may either have the same set points for spring 105 and fluid passage 126, or the respective settings may vary.

Methods of using slot perforating tool 100 may include building, purchasing, or otherwise providing slot perforating tool 100, providing a bottomhole assembly (e.g., perforating tool). The bottomhole assembly may be connected to slot perforating tool 100 and run into or otherwise placed in a wellbore, with mandrel 104 in a retracted position within body 102 of slot perforating tool 100. Depending on the wellsite, this may be done with coil tubing, jointed pipe, or any other suitable tubing string. Once the bottomhole assembly and slot perforating tool 100 are in place in a desired location within the wellbore, fluid may be pumped therethrough. When sufficient pump rate is reached, a perforation may begin to form in a casing, and thus a perforation may be initiated, with mandrel 104 remaining in the retracted position. This perforation may be extended into the formation surrounding the wellbore for a desired time, after which the pump rate may be increased to a predetermined pump rate that will cause mandrel 104 to move from the retracted position, as pumping continues. Thus, the bottomhole assembly will move downhole relative to the tubing string and the fluid passing therethrough will form a perforation that extends along a portion of the wellbore. Thus, in addition to extending into the formation, the perforation may extend along the wellbore to form a "slot."

Once a suitable slot has been formed, the pump rate may be reduced below the predetermined pump rate, allowing spring 105 to push or pull mandrel 104 back into a retracted position within body 102. This may occur while pumping continues, allowing the slot to be extended. Slot perforating tool 100, and the bottomhole assembly attached thereto may then be moved to another desired location within the wellbore and the process may be repeated without the need to pull out of hole. Thus, any number of additional perforations may be created and extended as desired.

While the illustrated embodiments indicate "upper" and "lower" with respect to various elements, the figures are not intended to be limiting on elements not described by such terms. For example, mandrel 104 may extend out of a "lower" end of body 102, and connect to a bottomhole assembly, while body 102 may connect to the tubing string. Likewise, "upper" and "lower" do not necessarily refer to the position of various elements when slot perforating tool 100 is in use, as slot perforating tool 100 may be used in vertical, horizontal, or inverted wells.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. In addition, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. An apparatus comprising:

a body movably arranged about a mandrel and comprising a tool connector at a bottom of the body that is adapted to connect to a bottomhole assembly, the body being movable between a retracted position, where the lower end of the mandrel is disposed within the body at or near the bottom of the body, and an expanded position, where the body has moved downwardly with respect to the mandrel such that the lower end of the mandrel is disposed within the body at an intermediate location along the body;

the mandrel slidingly disposed within the body and comprising an upper end, a lower end, a passage extending between the upper and lower ends, and a tubing string connector at the upper end for connecting the mandrel to a tubing string;

a first seal and a second seal each attached to the body and in sealing contact with the mandrel, thereby forming a chamber defined by the body, the mandrel, and the first and second seals;

a middle seal arranged within the chamber and being attached to the mandrel and in sealing contact with the body, the middle seal dividing the chamber into an upper cell and a lower cell and defining a fluid passage that controls the flow of fluid between the upper and lower cells; and a spring disposed within the chamber and configured to maintain the body in the retracted position until a predetermined pump rate is applied to the apparatus.

2. The apparatus of claim 1, wherein the spring comprises a tension spring lying in the lower cell.

3. The apparatus of claim 2, wherein the spring is coupled to the mandrel at a first end and coupled to the body at a second end, the spring being configured to bias the body to the retracted position and thereby protect the mandrel within the body.

4. The apparatus of claim 1, wherein the spring is a compression spring lying in the upper cell.

5. The apparatus of claim 1, further comprising a hydraulic fluid disposed within the chamber.

6. The apparatus of claim 1, wherein the spring is connected to the mandrel and the body.

7. The apparatus of claim 1, wherein at least one of the tool connector and the tubing string connector comprises a threaded connection.

8. The apparatus of claim 1, wherein the spring comprises metal.

9. The apparatus of claim 1, wherein a length of the apparatus in the retracted position is about 70% of a length of the apparatus in the extended position.

10. The apparatus of claim 1, wherein the first and second seals are spacers arranged within and forming part of the chamber.

11. A method comprising:

connecting a bottomhole assembly to a tool connector disposed at a bottom of a body of an apparatus;

connecting a tubing string to a tubing string connector disposed at a top of a mandrel slidingly disposed within the body of the apparatus, the mandrel comprising a passage from the tubing string connector to a bottom of the mandrel;

placing the apparatus and the bottomhole assembly and tubing string in a wellbore with the body in a retracted position, where a lower end of the mandrel is disposed within the body at or near the bottom of the body;

providing a fluid to the apparatus via the tubing string; and increasing a pump rate of the fluid into the apparatus to a predetermined pump rate, whereby a spring force of a spring arranged within a chamber defined between the body and the mandrel is overcome and thereby allows the body to move to an expanded position, where the body has moved downwardly with respect to the mandrel such that the lower end of the mandrel is disposed within the body at an intermediate location along the body.

12. The method of claim 11, further comprising:

reducing the pump rate of the fluid below the predetermined pump rate; and allowing the spring force to move the mandrel back to the retracted position.

13. The method of claim 11, wherein the bottomhole assembly comprises a perforating tool configured to create a perforation as the mandrel moves between the retracted and expanded positions and the perforating tool moves downward when the body moves downward with respect to the mandrel.

14. The method of claim 11, wherein the apparatus includes a middle seal arranged within the chamber and being attached to the mandrel and in sealing contact with the body, the middle seal dividing the chamber into an upper cell and a lower cell, the method further comprising:

flowing hydraulic fluid disposed within the chamber between the upper and lower cells via a fluid passage defined in the middle seal; and regulating a speed of the mandrel with the fluid passage as the mandrel moves between the retracted and expanded configurations.

* * * * *